US009298200B2

(12) United States Patent
Sakaguchi

(10) Patent No.: US 9,298,200 B2
(45) Date of Patent: Mar. 29, 2016

(54) CONSTANT VOLTAGE CIRCUIT WITH DROOPING AND FOLDBACK OVERCURRENT PROTECTION

(71) Applicant: Seiko Instruments Inc., Chiba-shi, Chiba (JP)

(72) Inventor: Kaoru Sakaguchi, Chiba (JP)

(73) Assignee: Seiko Instruments, Inc. (JP)

( * ) Notice: Subject to any disclaimer, the term of this patent is extended or adjusted under 35 U.S.C. 154(b) by 22 days.

(21) Appl. No.: 14/199,668

(22) Filed: Mar. 6, 2014

(65) Prior Publication Data

US 2014/0253070 A1 Sep. 11, 2014

(30) Foreign Application Priority Data

Mar. 8, 2013 (JP) ..... 2013-046803

(51) Int. Cl.
*G05F 1/573* (2006.01)

(52) U.S. Cl.
CPC ..... *G05F 1/573* (2013.01)

(58) Field of Classification Search
CPC ..... H02H 9/02; H02H 9/025; G05F 1/573; G05F 1/5735
USPC ..... 323/273–281, 315–316; 361/18, 93.1, 361/93.9
See application file for complete search history.

(56) References Cited

U.S. PATENT DOCUMENTS 6,998,826 B2 * 2/2006 Fukui ..... G05F 1/573 323/282
7,411,376 B2 * 8/2008 Zhang ..... 323/277
7,772,815 B2 * 8/2010 Okuda ..... G05F 1/56 323/276
7,944,663 B2 * 5/2011 Morino ..... 361/93.1
8,674,671 B2 * 3/2014 Hikichi et al. ..... 323/274
2003/0011952 A1 1/2003 Fukui
2005/0029999 A1 * 2/2005 Fukui ..... G05F 1/573 323/285
2005/0036246 A1 * 2/2005 Nagata ..... G05F 1/573 361/18
2006/0250740 A1 * 11/2006 Itoh ..... H02H 9/025 361/93.1
2007/0176582 A1 * 8/2007 Okuda ..... G05F 1/56 323/280
2008/0278127 A1 * 11/2008 Nagata ..... G05F 1/56 323/276
2009/0195953 A1 * 8/2009 Chen et al. ..... 361/87

FOREIGN PATENT DOCUMENTS

JP 2003-029856 A 1/2003

* cited by examiner

*Primary Examiner* — Timothy J Dole
*Assistant Examiner* — Ivan Laboy Andino
(74) *Attorney, Agent, or Firm* — Brinks Gilson & Lione

(57) ABSTRACT

The constant voltage includes a sense transistor through which a sense current flows based on an output current flowing through an output transistor; a current division circuit for dividing the sense current and outputting divided currents; a first current to voltage conversion circuit for converting a first division current output from the current division circuit to a first voltage; a second current voltage conversion circuit for converting a second division current output from the current division circuit to a second voltage; an output voltage detection circuit for controlling the current division circuit such that a drain voltage of the sense transistor becomes equal to a voltage of the output terminal; and an overcurrent protection circuit for controlling the output voltage and the output current by detecting an overcurrent flowing through the output transistor based on the first voltage.

3 Claims, 8 Drawing Sheets

CONSTANT VOLTAGE CIRCUIT WITH DROOPING AND FOLDBACK OVERCURRENT PROTECTION

RELATED APPLICATIONS

This application claims priority under 35 U.S.C. §119 to Japanese Patent Application No. 2013-046803 filed on Mar. 8, 2013, the entire content of which is hereby incorporated by reference.

BACKGROUND OF THE INVENTION

1. Field of the Invention

The present invention relates to a constant voltage circuit which supplies power to a load in an electronic device or an integrated circuit, and more specifically to an overcurrent protection circuit which prevents an overcurrent of the constant voltage circuit.

2. Background Art

A constant voltage circuit is required in order to obtain a desirable power supply voltage in an electronic device or an integrated circuit. The constant voltage circuit has a capability of outputting constant voltage and supplying power to a load. An overcurrent protection circuit is required in order to avoid a problem of a heat generation or the like caused by excessive power supplied when an output load of the constant voltage circuit flows to a large current or is short-circuited, and in order to obtain overcurrent protection characteristics with a good accuracy, various overcurrent protection circuits are proposed (for example, Patent Document 1).

An example of a circuit diagram of the constant voltage circuit including the overcurrent protection circuit of the related art is illustrated in FIG. 8.

An error amplifier 102 of the constant voltage circuit of the related art compares a reference voltage output from a reference voltage source 101 with a feedback voltage which is generated by dividing a voltage of an output terminal Vout using a voltage division circuit 104, and outputs a voltage which controls an output transistor 105 such that an output voltage is constant, and thereby the constant voltage circuit operates as a constant voltage circuit.

The overcurrent protection circuit 103 of the related art includes an output current sense transistor 106 which senses an output current and controls a PMOS transistor 107 based on a sense current output from the output current sense transistor 106, and operates such that the output current of the output transistor 105 does not become a current equal to or more than a predetermined limit current. The overcurrent protection circuit 103 is a drooping type overcurrent protection circuit.

In addition, the overcurrent protection circuit of the related art includes an output voltage detection circuit that is configured by an output current sense transistor 115 which supplies the sense current, an NMOS transistor 116 through which the sense current flows, an NMOS transistor 117 which configures a current mirror together with an NMOS transistor 116, a PMOS level shifter 118 through which a current proportional to the sense current flows, a PMOS level shifter 119 whose gate receives a drain voltage of the PMOS level shifter 118. The output voltage detection circuit controls such that the drain voltage of the output current sense transistor 115 is equal to the voltage of the output terminal Vout by the PMOS level shifter 119. Further, the drain voltage of the PMOS level shifter 118 is input to the gate of the PMOS level shifter 120, and thereby the control is performed in such a manner that the drain voltage of the output current sense transistor 106 becomes equal to the voltage of the output terminal Vout. By this configuration, a source-drain voltage of the output transistor 105 becomes equal to a source-drain voltage of the output current sense transistor 106, and thereby it is possible to obtain overcurrent protection characteristics with a good accuracy, although a voltage difference between an input terminal Vin and the output terminal Vout is small.

[Patent Document 1] Japanese Patent Application Laid-Open No. 2003-029856

SUMMARY OF THE INVENTION

However, there is a problem that in a constant voltage circuit of the related art, in order to simultaneously obtain drooping type overcurrent protection characteristics and overcurrent protection characteristics of foldback characteristics, designing a new foldback type overcurrent protection circuit is required, and a circuit size increases.

The present invention aims to provide a constant voltage circuit including an overcurrent protection circuit which has a good accuracy and both drooping type overcurrent protection characteristics and overcurrent protection characteristics of foldback characteristics, only by adding a simple circuit.

A constant voltage circuit according to the present invention is configured as follows in order to solve the problem.

The constant voltage includes a sense transistor through which a sense current flows based on an output current flowing through an output transistor; a current division circuit for dividing the sense current and outputting divided currents; a first current to voltage conversion circuit for converting a first division current output from the current division circuit to a first voltage; a second current voltage conversion circuit for converting a second division current output from the current division circuit to a second voltage; an output voltage detection circuit for controlling the current division circuit such that a voltage of the output terminal becomes equal to a drain voltage of the sense transistor; and an overcurrent protection circuit for controlling the output voltage and the output current by detecting an overcurrent flowing through the output transistor based on the first voltage.

The constant voltage circuit includes a sense transistor through which a sense current flows based on an output current flowing through an output transistor; a current division circuit for dividing the sense current and outputting divided currents; a first current to voltage conversion circuit for converting a first division current output from the current division circuit to a first voltage; a second current voltage conversion circuit for converting a second division current output from the current division circuit to a second voltage; an output voltage detection circuit for controlling the current division circuit such that a drain voltage of the sense transistor becomes equal to a voltage of the output terminal; and an overcurrent protection circuit for controlling the output voltage and the output current by detecting an overcurrent flowing through the output transistor based on the first voltage.

DESCRIPTION OF THE PREFERRED EMBODIMENTS

First Embodiment

Figure 1:
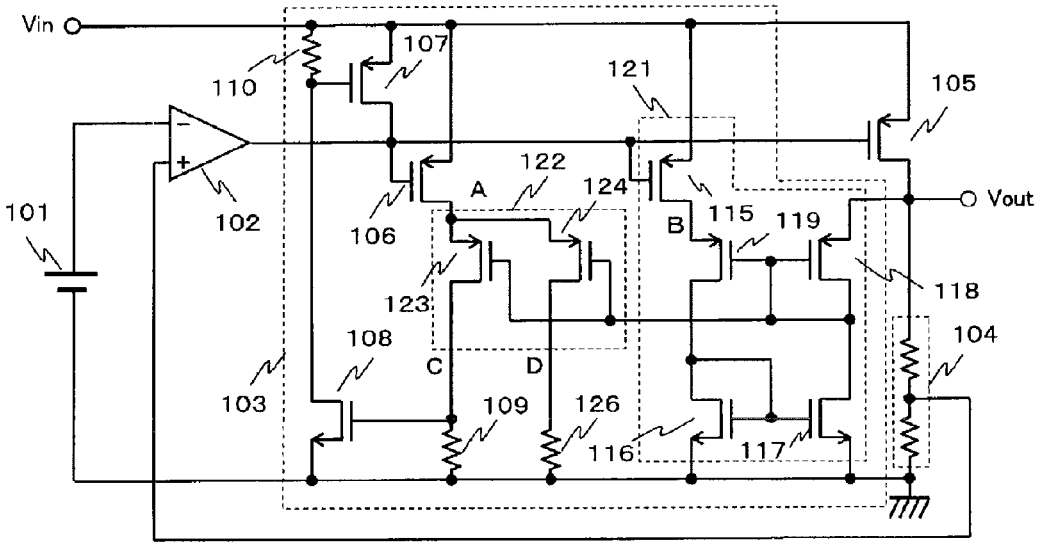
FIG. 1 is a circuit diagram illustrating a constant voltage circuit according to a first embodiment.

FIG. 1 is a circuit diagram illustrating a constant voltage circuit according to a first embodiment.

The constant voltage circuit according to the first embodiment includes a reference voltage source 101, an error amplifier 102, an overcurrent protection circuit 103, a voltage division circuit 104, and an output transistor 105.

The overcurrent protection circuit 103 includes a first output current sense transistor 106, a PMOS transistor 107, an NMOS transistor 108, resistors 109, 110 and 126, an output voltage detection circuit 121, and a current division circuit 122. The output voltage detection circuit 121 includes a second output current sense transistor 115, NMOS transistors 116 and 117, and PMOS level shifters 118 and 119. The current division circuit 122 includes PMOS level shifters 123 and 124. The resistor 109 corresponds to a first current voltage conversion circuit, and the resistor 126 corresponds to a second current voltage conversion circuit.

The error amplifier 102 is configured such that the inverted input terminal is connected to an output terminal of the reference voltage source 101, the non-inverted input terminal is connected to an output terminal of the voltage division circuit 104, and the output terminal is connected to a gate of the output transistor 105. The output transistor 105 is configured such that the source is connected to a power supply input terminal Vin, and the drain is connected to a constant voltage output terminal Vout. The voltage division circuit 104 is connected between the constant voltage output terminal Vout and the ground terminal, and the output terminal is connected to the non-inverted input terminal of the error amplifier 102.

The first output current sense transistor 106 is configured such that the gate is connected to the gate of the output transistor 105, the source is connected to the power supply input terminal Vin, and the drain is connected to an input terminal (A point) of the current division circuit 122. The current division circuit 122 is configured such that the first output terminal (C point) is connected to one terminal of the resistor 109 and a gate of the NMOS transistor 108, and the second output terminal (D point) is connected to one terminal of the resistor 126. The other terminals of the resistors 109 and 126 are each connected to the ground terminal. The NMOS transistor 108 is configured such that the source is connected to the ground terminal, and the drain is connected to one terminal of the resistor 110 and a gate of the PMOS transistor 107. The other terminal of the resistor 110 is connected to the power supply input terminal Vin. The PMOS transistor 107 is configured such that the source is connected to the power supply input terminal Vin, and the drain is connected to the gate of the output transistor 105.

Sources of the PMOS level shifters 123 and 124 are connected to an A point, and a level shift voltage of the output voltage detection circuit 121 is input to gates of the PMOS level shifters 123 and 124. A drain of the PMOS level shifter 123 is connected to the C point. A drain of the PMOS level shifter 124 is connected to the D point.

The second output current sense transistor 115 is configured such that the gate is connected to the gate of the output transistor 105, the source is connected to the power supply input terminal Vin, and the drain (B point) is connected to the source of the PMOS level shifter 119. The PMOS level shifter 119 is configured such that the gate is connected to the gate of the PMOS level shifter 118, the drain is connected to both the drain and gate of the NMOS transistor 116 and the gate of the NMOS transistor 117. Sources of the NMOS transistors 116 and 117 are connected to the ground terminal. A drain of the NMOS transistor 117 is connected to the drain of the PMOS level shifter 118. A source of the PMOS level shifter 118 is connected to the constant voltage output terminal Vout.

Next, an operation of the constant voltage circuit according to the first embodiment will be described.

The PMOS level shifters 123 and 124 of the current division circuit 122 configure a current mirror circuit together with the PMOS level shifter 118, and thereby each gate voltage of the PMOS level shifters 123 and 124 becomes equal to a drain voltage of the PMOS level shifter 118. Thus, a first sense current is divided into a first division current and a second division current based on a division ratio which is determined by a ratio between K values of the PMOS level shifters 123 and 124, and is then output.

A first sense current flows through the output current sense transistor 106, based on an output current flowing through the output transistor 105. The first sense current is divided into the first division current and the second division current by the current division circuit 122. Based on a voltage generated by the first division current and the resistor 109, a current flows through the NMOS transistor 108. Based on a voltage generated by the current and the resistor 110, the PMOS transistor 107 is controlled, and the output transistor 105 operates such that an output current thereof may not be a current equal to or more than a predetermined limit current.

A second sense current flows through the output current sense transistor 115, based on an output current flowing through the output transistor 105. A current mirror circuit constructed with the NMOS transistor 116 and the NMOS transistor 117, enables a current which is proportional to the second sense current to flow through the PMOS level shifter 118. By the PMOS level shifters 118 and 119 which configure the current mirror circuit, the output current sense transistor 115 is controlled such that the drain voltage thereof may be equal to the voltage of the constant voltage output terminal Vout.

Figure 2:
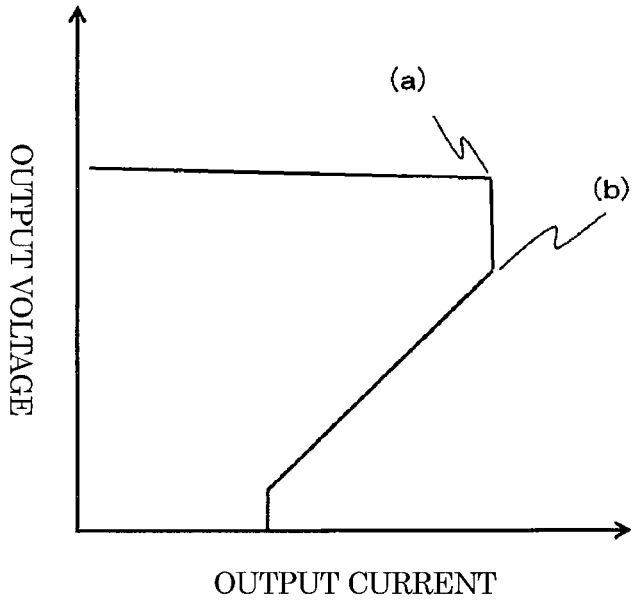
FIG. 2 is a diagram illustrating output voltage-output current characteristics of a constant voltage circuit according to the first embodiment.

FIG. 2 is a diagram illustrating output voltage-output current characteristics of the constant voltage circuit according to the first embodiment.

First, a load which is externally connected between the constant voltage output terminal Vout and the ground terminal changes from a high resistance state to a low resistance state, that is, a case where an output terminal current is increased in an area in which constant voltage circuit characteristics appear, will be described.

The larger the output current of the output transistor 105 becomes, the larger the first sense current output from the first output current sense transistor 106 becomes. The first sense current is input to the current division circuit 122, and distributed to the resistors 109 and 126 at a predetermined division ratio. Here, a current division ratio of the current division circuit 122 and a resistance value of the resistors 109 and 126 are set such that a voltage of the D point is higher than a voltage of the C point. In addition, under a condition that the characteristics of the constant voltage circuit appear, the resistor 126 is set such that the voltage of the D point does not reach the voltage of the A point. When the first sense current becomes large and the voltage generated between both terminals of the resistor 109 reaches a voltage satisfactory for turning on the NMOS transistor 108, a current flows through the NMOS transistor 108. Based on the current flowing through the NMOS transistor 108, a voltage generates between both terminals of the resistor 110. When the voltage generated between both terminals of the resistor 110 reaches a voltage satisfactory for turning on the PMOS transistor 107, a current flows through the PMOS transistor 107. By the current flowing through the PMOS transistor 107, the gate of the output transistor 105 is controlled, and the output transistor 105 operates such that the output current thereof may not be equal to or more than the predetermined limit current. This is an (a) point of the output voltage-output current characteristics.

Next, when the overcurrent protection circuit 103 begins to limit the output terminal current, the voltage of the constant voltage output terminal Vout begins to decrease. When the voltage of the constant voltage output terminal Vout begins to decrease, the voltage of the A point is also decreased by the operation of the output voltage detection circuit 121. When the voltage of the A point is close to the voltage of the D point, the PMOS level shifter 124 changes from a saturation operation state to a non-saturation operation state. Thus, the current division ratio between the PMOS level shifter 123 which continues the saturation operation state and the PMOS level shifter 124 begins to change, and the ratio of the first division current becomes large. This is a (b) point of the output voltage-output current characteristics.

When the ratio of the first division current becomes larger, the current flowing through the resistor 109 becomes larger, and thereby the voltage of the C point rises. When the voltage of the C point rises, the current flowing through the NMOS transistor 108 becomes large, so that the output current of the output transistor 105 is limited to a smaller current.

As the voltage of the constant voltage output terminal Vout is decreased, the ratio of the first division current becomes large, and thereby it is possible to decrease the output terminal current when the constant voltage output terminal Vout is short-circuited to the ground terminal.

Thus, it is possible for the constant voltage circuit according to the first embodiment to obtain overcurrent protection characteristics of a drooping type and a foldback type as illustrated in FIG. 2.

As described above, it is possible for the constant voltage circuit according to the first embodiment to obtain foldback type characteristics using a simple circuit to which the PMOS level shifter 124 and the resistor 126 are only added. Further, it is possible to obtain the foldback type characteristics using a change of the current division ratio of the first sense current, and thereby an effect is obtained that a consumption current does not increase.

Second Embodiment

Figure 3:
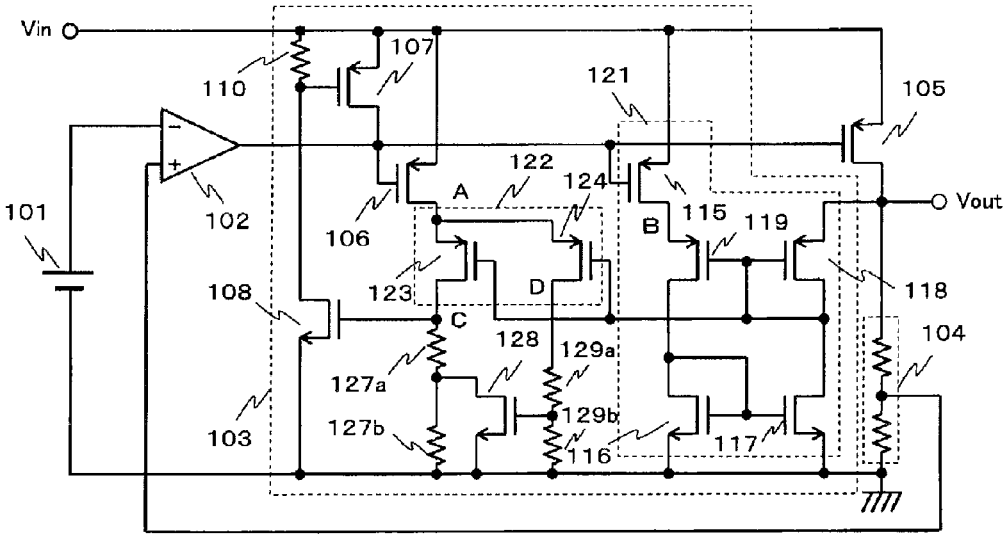
FIG. 3 is a circuit diagram illustrating a constant voltage circuit according to a second embodiment.

FIG. 3 is a circuit diagram illustrating a constant voltage circuit according to a second embodiment.

The constant voltage circuit according to the second embodiment includes a first current voltage conversion circuit and a second current voltage conversion circuit which are modified from those in the overcurrent protection circuit 103 of the constant voltage circuit according to the first embodiment.

In a circuit configuration of the constant voltage circuit according to the second embodiment, the same reference numerals and signs are attached to the same elements as those of the first embodiment, and the description will not be repeated.

The first current voltage conversion circuit includes a resistor 127*a*, a resistor 127*b*, and an NMOS transistor 128. The second current voltage conversion circuit includes a resistor 129*a* and a resistor 129*b*.

The resistors 127*a* and 127*b* are connected between the drain of the PMOS level shifter 123 and the ground terminal. A source and a drain of the NMOS transistor 128 are connected to both terminals of the resistor 127*b*. The resistor 129*a* and the resistor 129*b* are connected between the D point and the ground terminal, and a connection point between the resistor 129*a* and the resistor 129*b* is connected to a gate of the NMOS transistor 128.

The constant voltage circuit according to the second embodiment will be described.

Figure 4:
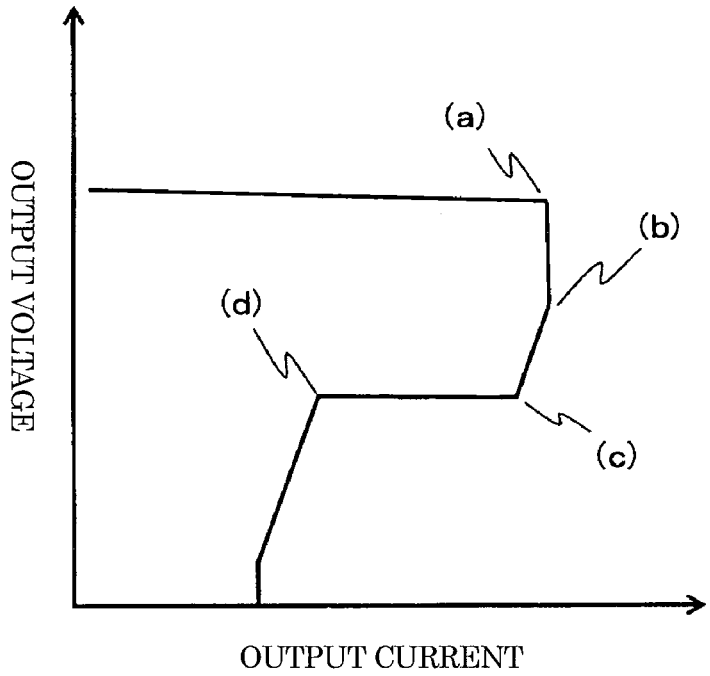
FIG. 4 is a diagram illustrating output voltage-output current characteristics of a constant voltage circuit according to the second embodiment.

FIG. 4 is a diagram illustrating output voltage-output current characteristics of the constant voltage circuit according to the second embodiment.

An operation of the constant voltage circuit performed up to a (b) point in FIG. 4 is the same as that of the constant voltage circuit according to the first embodiment. Here, until reaching the (b) point, the voltage of the D point is set to be higher than the voltage of the C point, and the resistance values of the resistors 129*a* and 129*b* are set such that the NMOS transistor 128 is turned on. That is, the first current voltage conversion circuit depends on the resistor 127*a*. When the voltage of the constant voltage output terminal Vout is decreased lower than that of the (b) point in FIG. 4, the voltage of the A point is also decreased in the same manner as the voltage of the constant voltage output terminal Vout by the operation of the output voltage detection circuit 121. When the voltage of the A point is close to the voltage of the D point, the PMOS level shifter 124 changes from the saturation operation state to the non-saturation operation state. Thus, the division ratio between the PMOS level shifter 123 which continues the saturation operation state and the PMOS level shifter 124 is changed, and the ratio of the first division current becomes large. Since the ratio of the second division current becomes small, the voltage of the D point is decreased, and the connection point between the resistor 129*a* and the resistor 129*b*, that is, the gate voltage of the NMOS transistor 128 is also decreased. Then, when the NMOS transistor 128 is turned off, the first current voltage conversion circuit depends on the resistors 127*a* and 127*b* connected in series to each other. Thus, by the voltage of the C point which is increased, the current of the NMOS transistor 108 increases, and the output current of the output transistor 105 is more strongly limited. This corresponds to a (c)-(d) section of the output voltage-output current characteristics. That is, the output terminal current decreases from the (c) point to the (d) point. After reaching the (d) point, the operation of the constant voltage circuit is the same as that of the first embodiment, and it is possible to decrease the output terminal current when the constant voltage output terminal Vout is short-circuited to the ground terminal.

As described above, it is possible for the constant voltage circuit according to the second embodiment to sharply limit the current from the (C) point to the (d) point of FIG. 4, and thus, it is possible to easily decrease the output terminal current at the time of the short-circuit of the output, and to obtain an effect that it is possible to avoid a condition of a large heat loss. In addition, adjustments of both the division ratio of the current division circuit 122 and the resistors 127*a*, 127*b*, 129*a*, and 129*b* are performed, and thereby it is possible to easily adjust change points of the (b) point, the (c) point, and the (d) point.

Further, the foldback type characteristics are obtained using the change of the current division ratio of the first sense current, and thereby an effect is obtained that the consumption current does not increase.

Third Embodiment

Figure 5:
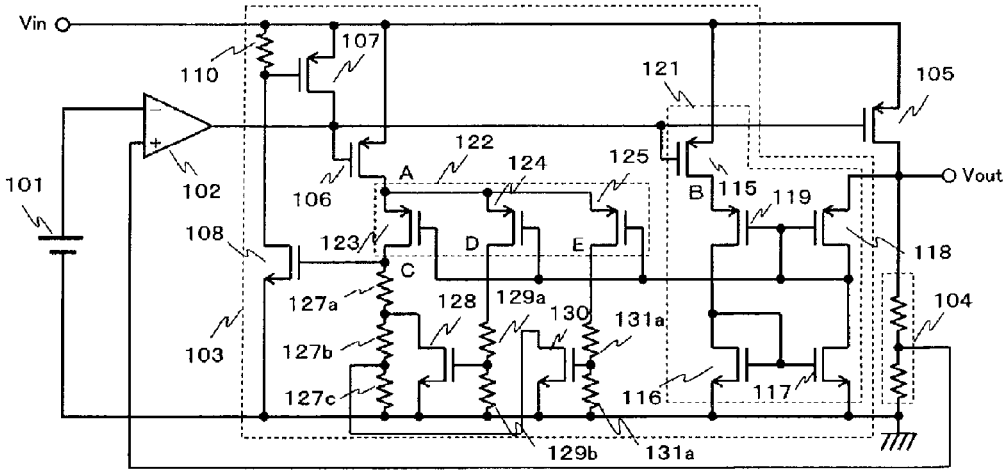
FIG. 5 is a circuit diagram illustrating a constant voltage circuit according to a third embodiment.

FIG. 5 is a circuit diagram illustrating a constant voltage circuit according to a third embodiment.

The constant voltage circuit according to the third embodiment includes a current division circuit 122 and a first current voltage conversion circuit which are modified from those in the overcurrent protection circuit 103 of the constant voltage circuit according to the second embodiment, and includes a third current voltage conversion circuit which is newly added.

In a circuit configuration of the constant voltage circuit according to the third embodiment, the same reference numerals and signs are attached to the same elements as those of the second embodiment, and the description will not be repeated.

The current division circuit 122 further includes a PMOS level shifter 125. The first current voltage conversion circuit includes a resistor 127*a*, a resistor 127*b*, a resistor 127*c*, an NMOS transistor 128, and an NMOS transistor 130. The third current voltage conversion circuit includes a resistor 131*a* and a resistor 131*b*.

The resistor 127*a*, the resistor 127*b*, and the resistor 127*c* are connected between the drain of the PMOS level shifter 123 and the ground terminal. A source of the PMOS level shifter 125 is connected to the A point, a level shifter voltage of the output voltage detection circuit 121 is input to a gate of the PMOS level shifter 125, and a drain of the PMOS level shifter 125 is connected to a third output terminal (E point) of the current division circuit 122. A source and a drain of the NMOS transistor 128 are connected to both terminals of the resistors 127*b* and 127*c*. A source and a drain of the NMOS transistor 130 are connected to both terminals of the resistor 127*c*. The resistor 131*a* and the resistor 131*b* are connected between the E point and the ground terminal, and a connection point between the resistors 131*a* and 131*b* is connected to the gate of the NMOS transistor 130.

An operation of the constant voltage circuit according to the third embodiment will be described.

Figure 6:
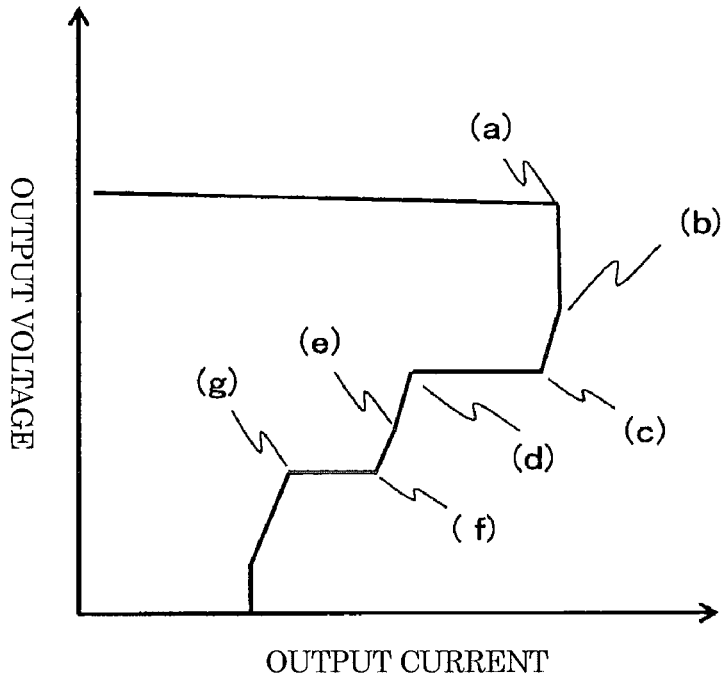
FIG. 6 is a diagram illustrating output voltage-output current characteristics of a constant voltage circuit according to the third embodiment.

FIG. 6 is a diagram illustrating output voltage-output current characteristics of the constant voltage circuit according to the third embodiment.

Here, a current division ratio of the current division circuit 122 and resistance values of each current voltage conversion circuit are set such that a voltage of the E point is higher than the voltage of the C point and the voltage of the D point is higher than the voltage of the E point. In addition, under a condition that the characteristics of the constant voltage circuit appear, the resistance values of each current voltage conversion circuit are set such that the voltages of the D point and the E point do not reach the voltage of the A point and the NMOS transistor 128 and the NMOS transistor 130 are turned on.

An operation of the constant voltage circuit performed up to a (d) point in FIG. 6 is the same as that of the constant voltage circuit according to the second embodiment. In the (a) point, when the overcurrent protection circuit 103 begins to limit the output current, the voltage of the constant voltage output terminal Vout is decreased. When the voltage of the constant voltage output terminal Vout is decreased, the voltage of the D point is close to the voltage of the A point, and the division ratio of the current division circuit begins to change ((b) point). When the voltage of the D point is decreased by the voltage of the constant voltage output terminal Vout which is decreased, the NMOS transistor 128 is turned off ((c) point), and the output terminal current is more strongly limited ((d) point). When the voltage of the constant voltage output terminal Vout is further decreased, the voltage of the A point is also decreased in the same manner as the voltage of the constant voltage output terminal Vout by the operation of the output voltage detection circuit 121. When the voltage of the A point is close to the voltage of the E point, the PMOS level shifter 125 changes from the saturation operation state to the non-saturation operation state, the division ratio between the PMOS level shifter 123 which continues the saturation operation state and the PMOS level shifter 125 begins to change, and the ratio of the first division current output from the PMOS level shifter 123 becomes larger ((e) point). In contrary, since the ratio of the third division current becomes small, the voltage of the E point is decreased, the NMOS transistor 130 is turned off ((f) point), a change is performed such that the first division current flows through the resistor 127*c*, and thus, the voltage of the C point is increased. When the voltage of the C point rises, the output current of the output transistor 105 is more strongly limited, and the output terminal current is decreased until a (g) point. After reaching the (g) point, the operation of the constant voltage circuit is the same as those of the first and second embodiments, and it is possible to decrease the output terminal current when the constant voltage output terminal Vout is short-circuited to the ground terminal.

As described above, it is possible to gradually obtain foldback type overcurrent protection characteristics beginning from the (c) point so as to be the (g) point from the (d) point, in the constant voltage circuit according to the third embodiment. Meanwhile, it is possible to set the voltage value or the current value to various combinations of the resistance value or the current division ratio, and thus, an effect is obtained in which a degree of freedom of design is high and desirable overcurrent protection characteristics are easily obtained.

Further, since the foldback type characteristics are obtained using the change of the current division ratio of the first sense current, an effect is also obtained in that the consumption current does not increase.

Further, in the third embodiment, the current division circuit 122 is configured to output three division currents, but the division number for obtaining the effects of the present invention is not limited thereto.

Figure 7:
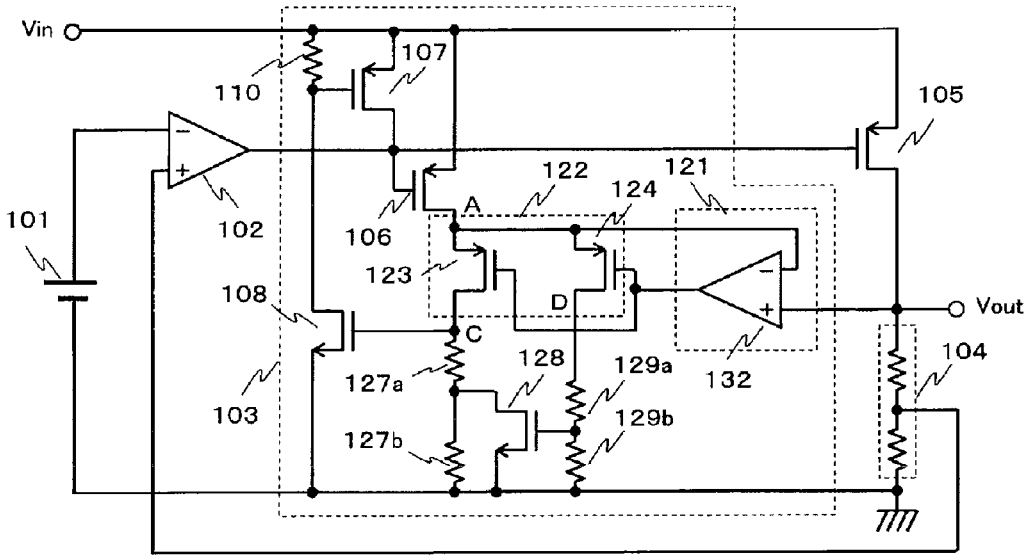
FIG. 7 is a circuit diagram illustrating another example of an output voltage detection circuit.
Figure 8:
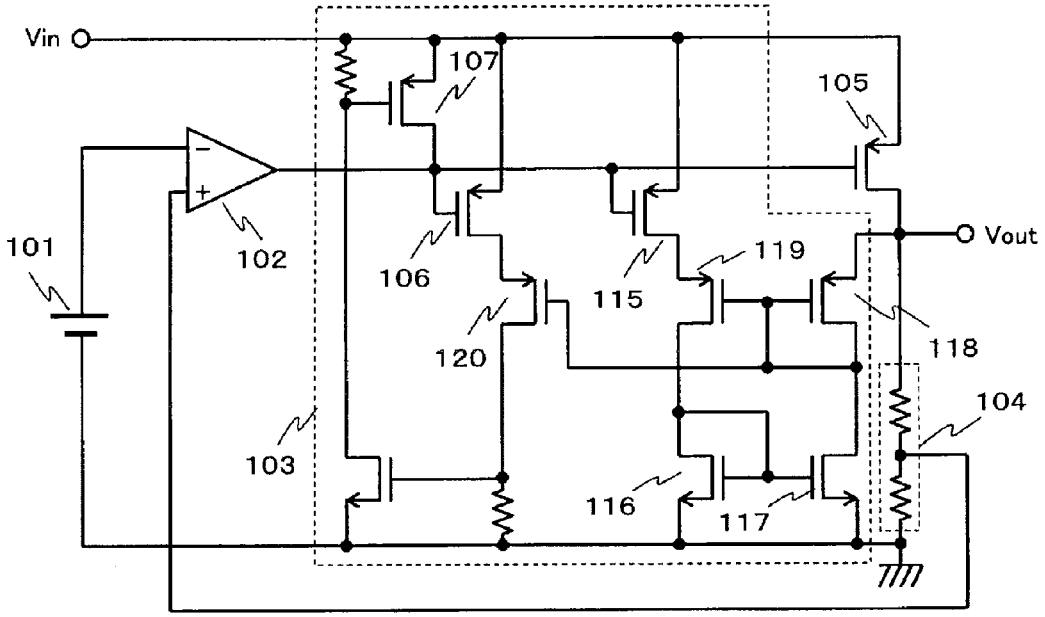
FIG. 8 PRIOR ART
FIG. 8 is a circuit diagram illustrating an example of a constant voltage circuit including an overcurrent protection circuit of the related art.

In the first to third embodiments described above, the output voltage detection circuit 121 is described using a configuration which includes the output current sense transistor 115 and the current mirror circuit, but is not limited thereto, if a circuit having the same functions is used. For example, the output voltage detection circuit 121 may be configured to have an error amplifier 132, in the same manner as the output voltage detection circuit 121 illustrated in FIG. 7.

The error amplifier 132A is configured such that the non-inverting input terminal is connected to the constant voltage output terminal Vout, the inverting input terminal is connected to the drain of the output current sense transistor 106, and the output terminal is connected to the gates of the PMOS level shifters 123 and 124.

The output voltage detection circuit 121 configured in this way compares a voltage of the constant voltage output terminal Vout which is input to the non-inverting input terminal of the error amplifier 132 with the voltage of the A point, and controls the gates of the PMOS level shifters 123 and 124 such that the voltage of the A point is equal to the voltage of the constant voltage output terminal Vout.

What is claimed is:

1. A constant voltage circuit for converting an input voltage into a predetermined output voltage and outputting the predetermined output voltage to an output terminal, comprising:

a sense transistor through which a sense current flows based on an output current flowing through an output transistor;

a current division circuit for dividing the sense current and outputting divided currents;

a first current to voltage conversion circuit for converting a first division current output from the current division circuit to a first voltage;

a second current to voltage conversion circuit for converting a second division current output from the current division circuit to a second voltage;

an output voltage detection circuit for controlling the current division circuit such that a drain voltage of the sense transistor becomes equal to the predetermined output voltage at the output terminal; and an overcurrent protection circuit for controlling the predetermined output voltage and the output current by detecting an overcurrent flowing through the output transistor based on the first voltage;

wherein the current division circuit comprises a first PMOS level shifter and a second PMOS level shifter, whose sources are connected to a drain of the sense transistor; a level shift voltage of the output voltage detection circuit is input to both gates of the first and the second PMOS level shifters; and a drain of the first PMOS level shifter is connected to the first current to voltage conversion circuit and a drain of the second PMOS level shifter is connected to the second current to voltage conversion circuit.

2. The constant voltage circuit according to claim 1, wherein the first current to voltage conversion circuit includes a variable resistor therein which varies its resistance value in accordance with an output signal of the second current to voltage conversion circuit.

3. The constant voltage circuit according to claim 1, wherein the overcurrent protection circuit further comprises a third current to voltage conversion circuit for converting a third division current output from the current division circuit to a third voltage; and the first current to voltage conversion circuit includes a variable resistor therein which varies its resistance value in accordance with both of output signals of the second current to voltage conversion circuit and the third current to voltage conversion circuit.

* * * * *